United States Patent [19]

Matsumoto et al.

[11] Patent Number: 4,719,172

[45] Date of Patent: Jan. 12, 1988

[54] DESENSITIZING GUM FOR LITHOGRAHIC PRINTING PLATES

[75] Inventors: Hiroshi Matsumoto; Tadao Toyama, both of Shizuoka, Japan

[73] Assignee: Fuji Photo Film Co., Ltd., Minami-Ashigara, Japan

[21] Appl. No.: 882,514

[22] Filed: Jul. 7, 1986

[30] Foreign Application Priority Data

Jul. 10, 1985 [JP] Japan ..... 60-151924

[51] Int. Cl.[1] ..... G03T 7/02

[52] U.S. Cl. ..... 430/309; 101/450.1; 430/302; 106/2; 106/14.5

[58] Field of Search ..... 430/309, 302, 309; 106/2; 101/450.1, 451; 536/109

[56] References Cited

U.S. PATENT DOCUMENTS

| | | | |
|---|---|---|---|
| 3,053,178 | 9/1962 | Greubel | 101/451 |
| 3,553,195 | 1/1971 | Jarowenko | 536/62 |
| 3,745,028 | 7/1973 | Rauner | 101/451 |
| 3,870,527 | 3/1975 | Kryger et al. | 106/2 |

*Primary Examiner*—Theodore Morris

*Attorney, Agent, or Firm*—Burns, Doane, Swecker & Mathis

[57] ABSTRACT

A desensitizing gum comprising an aqueous solution containing at least one of film-forming starches modified with phosphoric acid or its derivatives. The desensitizing gum has good desensitizing ability and can easily be removed from a printing plate finished therewith after prolonged storage.

11 Claims, No Drawings

DESENSITIZING GUM FOR LITHOGRAHIC PRINTING PLATES

FIELD OF THE INVENTION

The present invention relates to a desensitizing gum for lithographic printing plates.

BACKGROUND OF THE INVENTION

In making lithographic printing plates, a step of coating a desensitizing gum, called a gumming-up step, is provided as a final step for protecting non-image areas (areas which retain water to repel a printing ink).

The desensitizing gum is applied to non-image areas to protect the hydrophilicity of the non-image areas as well as to protect the areas from being stained or flawed by adhesion of fingerprints, fats and oils, dusts, etc. upon correction of image areas such as retouching or deletion, during storage before printing and after plate making or storage before reuse, or upon handling to mount the printing plate on a press and, in addition, to prevent oxidative stains. Known gum compositions for lithographic printing plates which include compositions comprising an aqueous solution of gum arabic, cellulose gum or a water-soluble high molecular substance containing carboxy groups in the molecule and optionally containing a pH-adusting agent, an antiseptic, etc, have been popularly used. However, these conventionally known compositions have the following problems. That is, in the final step of finishing a printing plate, a gum solution is applied to the printing plate and spread all over the plate surface a using sponge or a cotton pad, followed by polishing the plate surface with a cotton pad or a cloth wiper until it becomes dry, upon which the water-soluble high molecular substance is thickly coated in part on image areas (areas which receive an ink). The thickly coated image areas have such a poor ink receptivity in printing that many copies must be printed before the image fully accepts ink. This phenomenon is generally called image blinding (so-called blinding). Where the above-described phenomenon takes place, the plate generally must be subjected to a washing step with water or weakly acidic solution to thereby remove the hydrophilic colloid adsorbed on the image areas for reproducing image areas. This washing step consumes much time, and hence there has been developed a removing solution for desensitizing gum as described in U.S. Pat. No. 4,024,085.

The coating of image areas with fats and oils before the gumming-up step has been carried out for the purpose of protecting ink-receptive properties of the image areas. However, this makes the plate-making step complicated and deteriorates workability and, in addition, it is not preferable due to the pollution and health hazard problems. Accordingly, attempts have been made at using a water-soluble organic high molecular compound which does not causing image blinding as a desensitizing gum. For example, U.S. Pat. No. 4,095,525, and British Pat. No. 2,010,298, West German Pat. No. 2,504,594, and Soviet Pat. No. 623,755 disclose dextrin, pullulan and its derivatives, carboxy-containing polyacrylamide derivatives, metyl acrylate (or methacrylate) grafted polyacrylamide copolymor, etc. However, these compounds are not desirable because they exert only a poor desensitizing action on non-image areas.

SUMMARY OF THE INVENTION

It is, therefore, an object of the present invention to provide a desensitizing gum which exerts a desensitizing action on non-image areas of a lithographic printing plate and which does not cause image blinding of image areas even when the plate is stored for a long period of time.

Another object of the present invention is to provide a desensitizing gum which can be easily applied to a printing plate using a sponge, a cotton pad or an automatic gum coater, which can be easily removed from the lithographic printing plate by washing with water or bringing the plate into contact with dampening rollers on a lithographic press, and which makes it possible to maintain the hydrophilicity in non-image areas.

As a result of intensive investigations for attaining the above-described objects, the inventors have achieved the present invention.

That is, the inventors have found that the above-described objects can be attained by using as a desensitizing gum at least one of film-forming starches modified with phosphoric acid or its derivatives (hereinafter referred to as "modified starch").

DETAILED DESCRIPTION OF THE INVENTION

Modified starches used in this invention are obtained by esterification of starches with phosphorus oxychloride, trimetaphosphoric acid salts (e.g. sodium salt), orthophosphoric acid salts, polyphosphoric acid salts, phosphoric acid, organic phosphonic acids, etc. There are two types of esters, i.e., monesters and crosslinked diesters, both of which can be used in this invention but monoesters are preferred because they are low in aging properties which are inherent in starch. As starches, there can be used those obtained from potato, sweet potato, wheat, tapioca, corn, glutinous corn, rice, glutinous rice, etc.

Theoretically maximum degree of esterification of modified starch is 3, wherein all three hydroxyl groups of glucose unit of starch have been esterified. Preferably the degree of esterification is 0.03 to 1.0, and particularly 0.1 to 0.6.

The modified starches used in the invention are esters between glucose constituting starch and phosphoric acid or its derivatives and are high molecular compounds having the repeating unit of the following formula:

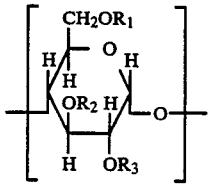

wherein $R_1$, $R_2$ and $R_3$ may be the same or different and each represent hydrogen atom or residue of phosphoric acid or its derivatives.

A process for the synthesis of the modified starches is described in "SUIYOSEI-KOBUNSHI, MIZUBUN-SANGATA-JYUSHI SOGO-GIJYUTSU SHIRYO-SYU (Water-soluble high molecular compounds, water dispersion type resin, General technical data)", published by KEIEI-KAIHATSU CENTER, Jan. 23, 1981, pages 68 to 69. Groups $R_1$, $R_2$ and $R_3$ in the formula can be selected to obtain various modified starches having desired properties.

The amount of modified starch contained in the desensitizing gum of the invention is preferably 0.1 to 30 wt. %, and particularly 0.3 to 8 wt. %. The modified starch can be dissolved in water at room temperature or elevated temperature (e.g., 70° to 80° C.) to obtain an aqueous solution which is used as a desensitizing gum.

In addition to modified starch, the desensitizing gum of this invention may contain other hydrophilic high molecular compounds.

Such hydrophilic high molecular compounds include cellulose derivative such as methyl cellulose, ethyl cellulose, hydroxyethyl cellulose or carboxymethyl cellulose; starch derivative such as roast starch, enzymatically modified starch, alkyleneoxide modified starch, α-starch, dextrin, or dialdehyde starch; and natural or semi-synthetic high molecular compound such as an alginic salt, locust bean gum, arabogalactan, pullulan, etc. Further, other synthetic high molecular compounds such as polyvinyl alcohol, polyvinyl pyrrolidone, polyacryl amide, polyvinyl methyl ether, polyethylene oxide, a copolymer of vinyl acetate and maleic anhydride, etc. may be used in combination with the modified starch. When gum arabic is used in combination, it can be used in a much smaller amount than usual to attain the object of this invention.

The total amount of hydrophilic high molecular compound (i.e. the amount of the modified starches plus the other hydrophilic high molecular compound.) contained in the desensitizing gum of the invention is 3 to 30 wt. %, preferebly 8 to 25 wt. % based on the total weight of the gum.

Generally, the desensitizing gum is advantageously used in an acidic condition, i.e., $p^H$ 2.5 to 6.0. For making the $p^H$ of the desensitizing gum 2.5 to 6.0, a mineral acid, an organic acid or an inorganic salt is added to the desensitizing gum in an amount of, usually, 0.01 to 2 wt. %.

Such mineral acids include nitric acid, sulfuric acid, phosphoric acid, etc. Such organic acids include citric acid, acetic acid, oxalic acid, malonic acid, p-toluene sulfonic acid, tartaric acid, malic acid, lactic acid, levulinic acid, organic phosphonic acid and such inorganic salts include magnesium nitrate, monosodium phosphate, disodium phosphate, nickel sulfate, sodium hexametaphosphate, sodium tripolyphosphate, etc. Two or more of the mineral acids, organic acids or inorganic salts can be used in combination.

The desensitizing gum of the invention may contain a surfactant to improve the surface properties of the coating. Such surfactans include those of anionic and nonionic types.

Anionic sufactants include aliphatic alcohol sulfuric ester salts, aliphatic alcohol phosphoric ester salts, sulfonic acid salts of dibasic aliphatic acid esters, aliphatic amide sulfonic acid salts, alkyl aryl sulfonic acid salts, and formaldehyde condensed naphthalenesulfonic acid salts.

Such nonionic surfactants include polyethylene glycol alkyl ethers, polyethylene glycol alkyl esters, sorbitan alkyle esters, and polyoxypropylene polyoxyethylene ethers. These surfactants may be used in combination of two or more. The amount of these surfactants added is not particularly restricted but is preferably 0.01 to 10 wt. % based on the total weight of the desensitizing gum.

In addition to the above components, a lower polyhydric alcohol such as glycerin, ethylene glycol, triethylene glycol may be used as a wetting agent. The amount of the wetting agent contained is suitably 0.1 to 5.0 wt. %, preferably 0.5 to 3.0 wt. %. Further the desensitizing gum of the invention may contain an antiseptics such as benzoic acid or its derivatives, phenol, formalin, sodium dehydroacetate, etc. in an amount of 0.005 to 2.0 wt. %.

The desensitizing gum of the present invention can be applied to various lithographic printing plates. It is particularly preferable to apply it to lithographic printing plates obtained by imagewise exposing and developing presensitized plates (which will be called "PS plate" hereinafter) comprising a support of an aluminum plate having provided thereon a light-sensitive layer. Preferable examples of negative working PS plates such as those comprising an aluminum plate having provided thereon a light-sensitive layer composed of a mixture of diazo resin (salt of a condensate between p-diazodiphenylamine and paraformaldehyde) and shellac as described in British Pat. No. 1,350,521; or those comprising an aluminum support having provided thereon a light-sensitive layer composed of a mixture of diazo resin and a polymer having hydroxyethyl methacrylate units or hydroxyethyl acrylate units as major repeating units, as described in British Pat. Nos. 1,460,978 and 1,505,739; and positive-working PS plates comprising an aluminum plate having provided thereon a light-sensitive layer composed of a mixture of an o-quinonediazide light-sensitive compound and a novalak type phenol resin, as described in U.S. Pat. No. 4,123,279. Further, PS plates comprising an aluminum plate having provided thereon a light-sensitive layer of photo-crosslinkable photopolymer specifically described in U.S. Pat. No. 3,860,426, PS plates comprising an aluminum plate having provided thereon a light-sensitive layer of photopolymerizable photopolymer composition as described in U.S. Pat. Nos. 4,072,528 and 4,072,527, and PS plates comprising an aluminum plate having provided thereon a light-sensitive layer composed of a mixture of an azide and a water-soluble polymer as described in British Pat. Nos. 1,235,281 and 1,495,861 are also preferable.

One embodiment of applying the desensitizing gum of the present invention to a PS plate is described below. However, the invention is not limited thereto.

A PS plate is first imagewise exposed to light, then developed to prepare a lithographic printing plate. This lithographic printing plate is washed with water and, after squeezing away the water on the plate surface, a suitable amount of the desensitizing gum of the present invention is applied to the plate surface, followed by rubbing the surface with a sponge so as to spread the gum solution all over the plate surface and drying. Thus, non-image areas of the printing plate are protected, and the resulting lithographic printing plate can be stored. In order to start printing, the gum on the plate surface is washed away, and subsequent procedure are conducted in a usual manner to print copies. Alternatively, an automatic gum coater may be used to uniformly apply the gum onto the plate surface. Upon printing, sufficiently satisfactory, sharp and clear copies can be obtained immediately after initiations of printing without producing many spoiled copies, which is an important improvement over the prior art.

According to this invention, it is unnecessary to use a protective ink which has been used to hold lipophilic property of image areas in making planographic printing plates.

The invention is illustrated by the following non-limitative examples in which percent (%) and part are by weight unless otherwise indicated.

EXAMPLE 1

60 Parts of phosphoric acid modified starch (degree of esterification: 0.2, viscosity of 40% aqueous solution (25° C.): 300–400 cps) was dissolved in 769.7 parts of pure water at 70° to 80° C. After cooled to 30° C., there were added 150 parts of water-soluble polyoxypropylene modified starch and 10 parts of carboxymethyl cellulose (viscosity of 10% aqueous solution (25° C.): 410 cps). The resulting solution had the viscosity of 17 cps at 25° C. To this solution, there were added 5 parts of polyoxyethylene alkylsulfuric ester salt (anionic surfactant), 0.4 part of sodium dehydroacetate, 0.3 part of ethyl benzoate and 4.6 part of phosphoric acid (85%) to obtain a desensitizing gum of this invention.

A 0.24 mm thick aluminum plate was degreased in 7% trisodium phosphate aqueous solution at 60° C., washed with water and grained by rubbing with a nylon brush while applying pumice-water suspension. After washing with water, the plate was immersed in 5% potassium silicate ($SiO_2/K_2O$ molar ratio: 2.0) aqueous solution at 70°C. for 30 to 60 seconds, washed with water and then dried.

To the plate, there was applied a light-sensitive solution consisting of 2.0 parts of 2-hydroxyethyl methacrylate copolymer (prepared by the method described in EXAMPLE 1 of British Pat. No. 1,505,739), 0.12 part of 2-methoxy-4-hydroxy-5-benzoylbenzene sulfonic acid salt of a condensate of p-diazodiphenylamine and paraformaldehyde, 0.03 part of OIL BLUE #603 (produced by ORIENT KAGAKU KOGYO), 15 parts of 2-methoxy ethanol, 10 parts of methanol and 5.0 parts of ethylene chloride so as to obtain 1.8g/m$^2$ coating after drying. The presensitized plate thus prepared was exposed to light through a half-tone negative transparency developed with an aqueous developer consisting of 3.0 parts of sodium sulfite, 30.0 parts of benzylalcohol, 20.0 parts of triethanolamine, 5 parts of monoethanolamine, 10 parts of sodium t-butylnaphthalene sulfonate and 1000 parts of pure water, washed with water and dried.

The printing plate thus prepared was cut into three pieces. The first one was coated with 7° Bé gum arabic aqueous solution (about 15% aqueous solution) and excess gum was wiped off with a cloth to obtain a finished printing plate (Sample A).

The second one was coated with the desensitizing gum of the present invention and excess gum was wiped off with a cloth to obtain a finished printing plate (Sample B).

The third one was not treated and designated as Sample C.

These Samples A, B and C were stored in a chamber maintained at 45° C. and 85% RH for 3 days and then installed in HEIDELBELG KOR-D printing machine. With sample A, more than 100 spoiled copies had to be printed before sharp and clear copies were printed and, with samples B and C, 10 and 8 spoiled copies had to be printed, respectively.

As to stain during printing, samples A and B suffered no stains, whereas sample C was extremely easily stained. Thus, Sample B in which the desensitizing gum of this invention is used is excellent in both lipophilic property in image areas and hydrophilic property in non-image areas.

EXAMPLE 2

20 Parts of phosphoric acid modified starch (degree of esterification: 0.25, viscosity of 20% aqueous solution (25° C.): 450 cps) was dissolved in 786.7 parts of pure water at 70° to 80° C. After cooled to 30° C., there were added 160 parts of CREAM DEXTRIN #3 (produced by MATSUTANI KAGAKU Co.) and 20 parts of carboxy methyl cellulose (viscosity of 10% aqueous solution (25° C.): 250 cps). The resulting solution had a viscosity of 20 cps at 25° C.

In this solution, there were dissolved 0.5 part of dialkylsulfosuccinic ester salt (anionic surfactant) and 5.0 part of 40% aqueous solution of sodium alkyldiphenylether disulfonate (anionic surfactant), 3 parts of magnesium sulfate, and 0.8 part of sodium dehydroacetate, and 4 parts of 85% phosphoric acid was added to adjust the $p^H$ to 3.8 to obtain a desensitizing gum.

One part of naphthoquinone-1,2-diazido-5-sulfonic ester of polyhydroxyphenyl prepared by polycondensation of pyrogallol and acetone described in U.S. Pat. No. 3,635,709 and 2 parts of novolak type cresol-formaldehyde resin were dissolved in 40 parts of methyl cellosolve to prepare a light-sensitive solution. A 0.2 mm thick aluminum plate was grained, washed with water and dried. The light-sensitive solution was coated on the aluminum plate using whirler so as to result in a weight of about 2.0 g/m$^2$ after drying and dried to prepare a positive working presensitized plate. The plate was exposed to light through a half-tone positive transparency, developed with 3% sodium silicate aqueous solution, washed with water and dried.

The resulting printing plate was cut into three pieces. The first one was coated with 14° Bé gum arabic aqueous solution (about 27% aqueous solution) and the second one was coated with the desensitizing gum described above and excess gum was wiped off with a cloth to obtain finished plate Samples A and B, respectively. The third one was not coated and designated as Sample C.

These Samples A, B and C were stored in a chamber maintained at 45° C. and 85% RH for 7 days and then installed in HEIDELBELG KOR-D printing machine. Printing was conducted in a conventional manner. Samples A, B and C required 35, 5 and 3 spoiled copies, respectively before sharp and clear copies were printed. Background contamination was not found in Samples A and B but found frequently in Sample C. Thus, Sample B in which the desensitizing gum of this invention is used in excellent in both lipophilic property in image areas and hydrophilic property in non-image areas.

EXAMPLE 3

50 Parts of phosphoric acid modified starch (degree of esterification: 0.1, viscosity of 20% aqueous solution (25° C.): 450 cps), 100 parts of CREAM DEXTRIN, 50 parts of white dextrin (produced by MATSUTANI KAGAKU), 15 parts of polyvinyl pyrrolidone K-30, 2 parts of polyoxyethylene alkylphenolether (EMULGEN #950 (trademark), produced by KAO Corporation), 3 parts of sodium naphtalene sulfonate -formalin condensate (DEMOL P (trademark), produced by KAO Corporation), 5 parts of sodium hexametaphosphate, 0.5 part of ethyl benzoate and 5.0 parts of 85% phosphoric acid were dissolved in 769.5 parts of pure water to prepare a desensitizing gum which had a viscosity of 18 cps at 25° C.

In the same manner as in EXAMPLE 1, a presensitized plate was prepared, exposed to light, developed, washed with water and dried to obtain a printing plate which was cut into three pieces.

The first one was coated with 14° Bé gum arabic aqueous solution and the second one with the above desensitizing gum and excess gum was wiped off with a cloth to obtain finished plate Samples A and B, respectively. The third one was not coated and designated as Sample C.

In the same manner as in EXAMPLE 1, these Samples A, B and C were stored in a chamber maintained at 45° C. and 85% RH for 7 days and then installed in HEIDELBELG KOR printing machine. Printing was conducted in a conventional manner. With sample A, more than 100 spoiled copies had to be printed before sharp and clear copies were printed and, with samples B and C, 8 and 5 spoiled copies had to be printed, respectively. Background contamination was not found in Samples A and B but found frequently in Sample C. Thus, Sample B in which the desensitizing gum of this invention is used gave satisfactory results.

EXAMPLE 4

40 Parts of phosphoric acid modified starch (degree of esterification: 0.15, viscosity of 40% aqueous solution (25° C.): 300 to 400 cps), 50 parts of enzymatically hydrolyzed dextrin (AMYCOL 1B (trademark), produced by NICHIDEN KAGAKU Co.) 100 parts of CREAM DEXTRIN, 15 parts of a copolymer of methyl vinyl ether and maleic acid (GANTREZ S-95 (trademark), produced by GAF CORPORATION), 5 parts of glycerin, 4 parts of sodium alkylnaphthalene sulfonate (PELEX NBL (trademark), produced by KAO Corporation), 5 parts of polyoxyethylene alkylphenolether sulfuric acid salt (EMAL NC (trademark), produced by KAO Corporation), 2 parts of magnesium nitrate, 1 part of citric acid, 0.8 part of sodium dehydroacetate and 3.5 parts of 85% phosphoric acid were dissolved in 773.7 parts of water to prepare a desensitizing gum which had a viscosity of 17 cps at 25° C.

The printing plate prepared from the positive working presensitized plate of EXAMPLE 2 was coated with the desensitizing gum and stored at 45° C. and 85% RH for 7 days. Printing was conducted using this plate. Seven spoiled copies were required before sharp and clear copies were printed. No background contamination was observed. Thus, the desensitizing gum gave extremely satisfactory results.

What we claim is:

1. In a gumming-up process comprising applying to an imagewise exposed and developed presensitized plate, a desensitizing gum comprising an aqueous solution of a hydrophilic high molecular compound, the improvement characterized in that said hydrophilic high molecular compound comprises at least one of film-forming starches esterified with phosphoric acid or its derivatives.

2. The process of claim 1, wherein said phosphoric acid derivative is selected from the group consisting of phosphorus oxychloride, trimetaphosphoric acid salts, orthophosphoric acid salts, polyphosphoric salts, and organic phosphonic acids.

3. The process of claim 1, wherein said esterified starch is of monoester type.

4. The process of claim 1, wherein said esterified starch has a degree of esterification in the range of 0.03 to 1.0.

5. The process of claim 1, wherein said esterified starch has a degree of esterification in the range of 0.1 to 0.6.

6. The process of claim 1, wherein said esterified starch is contained in an amount of 0.1 to 30 wt. % based on the total weight of the desensitizing gum.

7. The process of claim 1, wherein said hydrophilic high molecular compound is contained in the range of 3 to 30 wt. % and said esterified starch is contained in the range of 0.3 to 8 wt. %, based on the total weight of the desensitizing gum.

8. The process of claim 7, wherein said hydrophilic high molecular compound other than the esterified starch is at least one selected from the group consisting of a cellulose, a roast starch, an enzymatically modified starch, an alkyleneoxide modified starch, an α-starch, a dextrin, a dialdehyde starch, an alginic salt, a locust bean gum, an arabogalactan, a pullulan a polyvinyl alcohol, a polyvinyl pyrrolidone, a polyacrylamide, a polyvinyl methyl ether, a polyethylene oxide, a copolymer of vinyl methyl ether and maleic anhydride, a copolymer of vinyl acetate and maleic anhydride, and gum arabic.

9. The process of claim 7, wherein said desensitizing gum further comprises a pH adjusting agent to make the pH of the gum in the range of 2.5 to 6.0.

10. The process of claim 7, wherein said desensitizing gum further comprises at least one of anionic and nonionic sarfactant in the range of 0.01 to 10 wt. % based on the total weight of the gum.

11. The process of claim 7, wherein said desensitizing gum further comprises a lower polyhydric alcohol in the range of 0.1 to 5 wt. % based on the total weight of the gum.

* * * * *